US010364528B2

(12) United States Patent
Nakamura et al.

(10) Patent No.: US 10,364,528 B2
(45) Date of Patent: Jul. 30, 2019

(54) ROPE AND METHOD OF MANUFACTURING THE SAME

(71) Applicants: National Institute of Advanced Industrial Science and Technology, Tokyo (JP); Kagawa Prefectural Government, Kagawa (JP); TAKAGI KOGYO Co., Ltd., Kagawa (JP)

(72) Inventors: Takako Nakamura, Ibaraki (JP); Tetsuo Tsuchiya, Ibaraki (JP); Hiroshi Shirakawa, Kagawa (JP); Toshimitsu Takagi, Kagawa (JP)

(73) Assignees: NATIONAL INSTITUTE OF ADVANCED INDUSTRIAL SCIENCE AND TECHNOLOGY, Tokyo (JP); KAGAWA PREFECTURAL GOVERNMENT, Kagawa (JP); TAKAGI KOGYO CO., LTD., Kagawa (JP)

( * ) Notice: Subject to any disclaimer, the term of this patent is extended or adjusted under 35 U.S.C. 154(b) by 48 days.

(21) Appl. No.: 15/316,333

(22) PCT Filed: Jun. 21, 2016

(86) PCT No.: PCT/JP2016/068361
§ 371 (c)(1),
(2) Date: Dec. 5, 2016

(87) PCT Pub. No.: WO2017/221318
PCT Pub. Date: Dec. 28, 2017

(65) Prior Publication Data
US 2018/0187371 A1 Jul. 5, 2018

(51) Int. Cl.
*D07B 1/02* (2006.01)
*D07B 1/16* (2006.01)
(Continued)

(52) U.S. Cl.
CPC ..... *D07B 1/02* (2013.01); *D06M 10/025* (2013.01); *D06M 10/06* (2013.01); *D06M 15/00* (2013.01);
(Continued)

(58) Field of Classification Search
CPC ..... D07B 1/025; D07B 1/04; D07B 1/02
(Continued)

(56) References Cited

U.S. PATENT DOCUMENTS 3,486,266 A * 12/1969 Howald ..... A01K 91/00 428/375
3,745,756 A * 7/1973 Crandall ..... A63B 51/02 57/234
(Continued)

FOREIGN PATENT DOCUMENTS

JP H03-249276 A 11/1991
JP 07-305277 A 11/1995
(Continued)

OTHER PUBLICATIONS

International Search Report and Written Opinion for PCT/JP20161068361 dated (Sep. 27, 2016).

*Primary Examiner* — Shaun R Hurley
*Assistant Examiner* — Bao-Thieu L Nguyen
(74) *Attorney, Agent, or Firm* — Pearne & Gordon LLP

(57) ABSTRACT

A rope including a yarn twisted by using a raw thread of a polyethylene fiber having an ultrahigh molecular weight and a strand twisted by the yarn and subjected to rope-making through the strand, and a resin coating layer for protecting the rope is formed on an external surface of the yarn, an external surface of the strand or an external surface of the rope. A method of manufacturing the rope includes a pre-treating step I of removing an oil content contained in the rope and performing an affinity enhancing treatment over a
(Continued)

surface thereof and a resin coating step II of forming a resin coating layer for protecting the rope on an external surface of the yarn, an external surface of the strand or an external surface of the rope. The resin coating layer for protecting the rope is formed.

12 Claims, 8 Drawing Sheets

(51) Int. Cl.

| | |
|---|---|
| ***D06M 15/00*** | (2006.01) |
| ***D06M 10/02*** | (2006.01) |
| ***D06M 10/06*** | (2006.01) |
| ***D07B 5/00*** | (2006.01) |
| ***D06M 15/19*** | (2006.01) |
| *D06M 101/20* | (2006.01) |

(52) U.S. Cl.
CPC ..... *D06M 15/19* (2013.01); *D07B 1/16* (2013.01); *D07B 5/006* (2015.07); *D06M 2101/20* (2013.01); *D06M 2200/12* (2013.01); *D07B 2201/2041* (2013.01); *D07B 2201/2044* (2013.01); *D07B 2501/2061* (2013.01); *D10B 2321/0211* (2013.01); *D10B 2401/021* (2013.01)

(58) Field of Classification Search
USPC ..... 57/273
See application file for complete search history.

(56) References Cited

U.S. PATENT DOCUMENTS 3,791,129 A * 2/1974 Shuford ..... D07B 5/00 57/211
3,882,665 A * 5/1975 Hughes ..... D07B 1/0693 57/217
4,250,702 A * 2/1981 Gundlach ..... D02G 3/40 57/251
4,809,492 A * 3/1989 Fischer ..... D07B 1/02 57/212
4,870,814 A * 10/1989 Chacko ..... D07B 1/148 57/217
4,966,635 A * 10/1990 Sato ..... H01B 5/004 148/275
5,098,787 A * 3/1992 Komatsu ..... C04B 16/06 428/343
5,303,498 A * 4/1994 Yutori ..... A01K 91/00 43/44.98
5,333,442 A * 8/1994 Berger ..... D04C 1/02 57/1 R
5,371,156 A * 12/1994 Komatsu ..... C04B 16/06 428/524
6,164,053 A * 12/2000 O'Donnell ..... B66B 7/06 187/251
6,945,153 B2 * 9/2005 Knudsen ..... D04C 1/12 87/1
7,032,371 B2 * 4/2006 Smith ..... B66B 7/06 57/237
7,296,394 B2 * 11/2007 Clough ..... D07B 1/02 57/210
7,409,815 B2 * 8/2008 Clough ..... D07B 1/068 57/212
7,435,909 B2 * 10/2008 Hager ..... G02B 6/4432 174/116
7,703,371 B2 * 4/2010 Morissette ..... D02G 3/38 87/13
7,814,740 B2 * 10/2010 Imanishi ..... D02G 3/48 57/210
8,978,532 B2 * 3/2015 Canedo Duarte da Rocha ..... D07B 1/0613 87/6
9,045,856 B2 * 6/2015 Hachisuka ..... D07B 1/0686
9,657,439 B2 * 5/2017 Lauer ..... D07B 1/16
9,909,240 B2 * 3/2018 Ardiff ..... D04H 1/58
9,944,494 B2 * 4/2018 Alasentie ..... B66B 7/064
2002/0134482 A1 * 9/2002 Takagi ..... B29B 15/122 152/527
2003/0177748 A1 * 9/2003 Patrick ..... D06B 1/02 57/258
2004/0026178 A1 * 2/2004 Honda ..... B66B 7/06 187/251
2006/0155328 A1 * 7/2006 Foerster ..... A61B 17/06166 606/228
2006/0196731 A1 * 9/2006 Honda ..... B66B 7/06 187/266
2006/0207414 A1 * 9/2006 Nye ..... D04C 1/12 87/7
2006/0213175 A1 * 9/2006 Smith ..... B66B 7/06 57/237
2007/0079695 A1 * 4/2007 Bucher ..... D02G 3/047 87/8
2009/0165637 A1 7/2009 Bosman et al.
2009/0206296 A1 * 8/2009 Dave ..... C11D 3/0015 252/8.62
2010/0055437 A1 * 3/2010 Fink ..... A61L 15/46 428/221
2011/0269009 A1 * 11/2011 Tsutsumi ..... H01M 2/16 429/120
2012/0198808 A1 8/2012 Bosman et al.
2012/0297746 A1 * 11/2012 Chou ..... D07B 1/02 57/230
2014/0069074 A1 * 3/2014 Lauer ..... D07B 1/16 57/232
2014/0248463 A1 9/2014 Tam et al.
2014/0302316 A1 * 10/2014 Gallens ..... B66B 7/062 428/379
2015/0209691 A1 * 7/2015 Ferrer ..... B01D 17/10 210/799
2015/0246623 A1 * 9/2015 Peruzzotti ..... D07B 1/147 191/41

FOREIGN PATENT DOCUMENTS

| | | | |
|---|---|---|---|
| JP | 2008-240215 | A | 10/2008 |
| JP | 2009517557 | A | 4/2009 |
| JP | 2013501161 | A | 1/2013 |
| JP | 2014531481 | A | 11/2014 |
| NO | 2007062803 | A1 | 6/2007 |
| NO | 2011015485 | A1 | 2/2011 |
| NO | 2013036448 | A2 | 3/2013 |

* cited by examiner

ROPE AND METHOD OF MANUFACTURING THE SAME

TECHNICAL FIELD

The present invention relates to a rope and a method of manufacturing the same. In more detail, the present invention relates to a rope which has a light weight and a high strength and is excellent in a wear resistance and a method of manufacturing the same.

A field of use of the rope according to the present invention is not particularly restricted but can be utilized in all technical fields. A typical example of use can include a rope for a marine structure and a rope for mooring a ship.

BACKGROUND ART

A mooring buoy can be illustrated as an example of use of a mooring rope. As shown in FIG. 8, upper ends of chains 101 are coupled to a mooring buoy B and an anchor AC is coupled to lower ends. The anchor AC is provided on a sea bottom and the mooring buoy B floats on a sea surface. In consideration of the rise and fall of a tide, a length of the chain 101 has a margin. In same cases, therefore, the chain 101 comes in contact with sand on a sea bottom or the like.

Although the chain 101 itself is formed of steel and has a high strength, it tends to be deteriorated by rust. If sand on a sea bottom intrudes into a portion between adjacent chains 101 so that it is often rubbed many times, wear of a corrosion layer proceeds quickly and is thus broken away. For this reason, the chain 101 is to be exchanged every two years or the like. Although an exchanging work is carried out in the water, the chain 101 has a great weight and a diver cannot perform the work and a working ship is required. As a result, a working cost is increased.

It is possible to solve the problem by using a rope in place of the chain 101. For example, the exchanging work in the water can be performed with a small load. When the rope is used in the sea, however, there is a problem in that sand and other fine impurities in the sea intrude into an inner part from the mesh of the rope and the rope is thus broken away in the early stage due to a friction between the impurities and a rope fiber.

The related art for preventing the friction of a rope or the like includes Patent Documents 1 to 3.

The Patent Document 1 discloses a rope-shaped thing in which a fiber structure obtained by twisting an organic fiber is set to be a core material portion and a surface thereof is coated with a thermoplastic resin.

Referring to the Patent Document 1, however, a coating configuration is unknown and it is characterized in that a resin to be used has thermoplasticity. Although the thermoplastic resin is convenient for coating formation, it has an unknown resistance in use for a long time with immersion in the sea.

The Patent Document 2 features a strand having a three-layer structure. An inner layer is a yarn obtained by collecting raw threads, and an outer intermediate layer thereof is a layer coated with a thermoplastic resin and an external layer on an outside thereof is a yarn obtained by twisting raw threads. In other words, the strand has a layer structure including an inner layer yarn, an intermediate coating layer and an outer layer yarn. For this reason, the strand is thickened and a rope obtained by knitting the thickened strand must be thick.

Moreover, the outer layer yarn exposed to an external surface of the strand is not protected by resin coating. In use in the sea, therefore, there is still a problem in that it is impossible to prevent wear from being caused by mixture of impurities in the sea, resulting in breakaway in the early stage.

Referring to the related art disclosed in the Patent Document 3, a cover is attached to an outer periphery of a rope, and the cover is configured from a rectangular cover body using a cloth-shaped member, a band-shaped non-slip mat, a flap and a surface fastener and is used with a proper part of the rope covered therewith.

However, the cover cannot prevent the intrusion of gravel on a sea bottom from intruding into an inner part of the rope. Thus, there is a great restriction to use in the sea.

Moreover, the cover is partially attached because the operability of the rope is damaged by attachment to a full length of the rope. For this reason, a wear resistance cannot be given to the full length of the rope.

PRIOR ART DOCUMENT

Patent Document

[Patent Document 1] Japanese Laid-Open Patent Publication No. Hei 9-209280

[Patent Document 2] Japanese Laid-Open Patent Publication No. 2000-178888

[Patent Document 3] Japanese Laid-Open Patent Publication No. 2007-320559

SUMMARY OF THE INVENTION

Problems to be Solved

In consideration of the circumstances, it is an object of the present invention to provide a rope which is hard to wear regardless of use in the sea and can maintain a long life. Moreover, it is an object of the present invention to provide a manufacturing method which implements the rope.

Means for Solving the Problem

A rope according to a first invention includes a yarn twisted by using a raw thread of a polyethylene fiber having an ultrahigh molecular weight and a strand twisted by the yarn and subjected to rope-making through the strand, and a resin coating layer for protecting the rope is formed on an external surface of the yarn, an external surface of the strand or an external surface of the rope.

A rope according to a second invention is directed to the rope according to the first invention, wherein the yarn is a second yarn obtained by twisting a first yarn.

A rope according to a third invention is directed to the rope according to the first invention, wherein the resin coating layer includes an inner coating layer constituted by a resin layer having affinity to the raw thread and an outer coating layer constituted by a hydrophobic resin layer formed on an external surface of the inner coating layer.

A rope according to a fourth invention is directed to the rope according to the first invention, wherein only a hydrophobic resin layer constituted by a hydrophobic resin is used for the resin coating layer.

A rope according to a fifth invention is directed to the rope according to the first invention, wherein the resin coating layer is constituted by an affinity and hydrophobic resin layer having both properties of an affinity resin and a hydrophobic resin.

A method of manufacturing a rope according to a sixth invention is characterized by a yarn twisted by using a raw thread of a polyethylene fiber having an ultrahigh molecular weight and a strand twisted by using the yarn and subjected to rope-making through the strand, the method including a pretreating step of removing an oil content contained in the rope to perform a hydrophilic enhancing treatment over a surface thereof, and a resin coating step of forming a resin coating layer for protecting the rope over an external surface of the yarn, an external surface of the strand or an external surface of the rope.

A method of manufacturing a rope according to a seventh invention is directed to the method according to the sixth invention, wherein the pretreating step is executed in a state of a yarn.

A method of manufacturing a rope according to an eighth invention is directed to the method according to the seventh invention, wherein the resin coating step includes a first coating step of forming an affinity resin layer having affinity to the raw thread on a surface of a yarn subjected to the pretreating step, a first drawing step of pressurizing and drawing the yarn subjected to the first coating step from an outer periphery, a second coating step of forming a hydrophobic resin layer on an external surface of the affinity resin layer of the yarn subjected to the first drawing step, and a second drawing step of pressurizing and drawing the yarn subjected to the second coating step from an outer periphery.

A method of manufacturing a rope according to a ninth invention is directed to the method according to the seventh invention, wherein the resin coating step includes a coating step of forming a hydrophobic resin layer on a surface of a yarn subjected to the pretreating step, and a drawing step of pressurizing and drawing the yarn subjected to the coating step from an outer periphery.

A method of manufacturing a rope according to a tenth invention is directed to the method according to the seventh invention, wherein the resin coating step includes a coating step of forming an affinity and hydrophobic resin layer on a surface of a yarn subjected to the pretreating step, and a drawing step of pressurizing and drawing the yarn subjected to the coating step from an outer periphery.

Effect of the Invention

According to the first invention, the resin coating layer for protecting the rope is formed. Therefore, waste, sand or the like in the sea is prevented from intruding into the inner part of the rope. For this reason, wear is not caused by rubbing of the yarns or strands against each other. Even if the rope comes in contact with a fixed thing in the sea or on the sea, moreover, the direct contact of a rope body is avoided by the resin coating layer. For these reasons, a life of the robe can be enhanced.

According to the second invention, when the second yarn is coated with a resin, a protecting effect with the same performance can be obtained through a processing man-hour which is one-xth (x is three to five) as compared with the case in which the first yarn is coated with a resin.

According to the third invention, the resin of the inner coating layer causes the hydrophobic resin of the outer layer to strongly adhere to the yarn, the strand or the rope body. Therefore, a resin coating resistance can be increased. In addition, the hydrophobic resin layer prevents intrusion of sea water into the rope. Therefore, intrusion of sand in the sea water or the like is prevented. From this viewpoint, similarly, the life of the rope can be enhanced.

According to the fourth invention, the intrusion of the sea water into the rope is prevented so long as the hydrophobic resin layer is coated. Therefore, the sand in in the sea water or the like is prevented. From this viewpoint, similarly, the life of the rope can be enhanced.

According to the fifth invention, the affinity resin contained in the affinity and hydrophobic resin layer causes the hydrophobic resin of the outer layer to adhere to the yarn, the strand or the rope body. Therefore, a period for exhibiting the life of the rope can be prolonged. In addition, the hydrophobic resin prevents the sea water from intruding into the rope. Therefore, the intrusion of the sand in the sea water or the like can be prevented. From this viewpoint, similarly, the life of the rope can be enhanced.

According to the sixth invention, the oil content is removed through the pretreating step. Consequently, conditions for enabling resin coating are met. Subsequently, the external surface of the yarn or the strand is caused to have affinity to the resin. Therefore, the resin of the resin coating layer strongly adheres. Therefore, it is possible to obtain a rope protected firmly by the resin coating layer.

According to the seventh invention, when the second yarn is coated with a resin, it is possible to obtain a rope with the same performance through a processing man-hour (which is one-xth (x is three to five)) as compared with the case in which the first yarn is coated with a resin.

According to the eighth invention, when the first drawing step is performed after the first coating step, the resin which has just been coated intrudes into the inner part of the yarn. Therefore, the resin serves as a binder for bundling taw threads constituting the yarn and reduces wear caused by rubbing if any. Even if the resin serves as the binder for bundling the raw threads constituting the yarn and the rubbing is caused, moreover, it reduces the wear caused thereby. When the second drawing step is performed after the second coating step, moreover, the resin which has just been coated further intrudes into the inner part of the yarn. Therefore, the resin serves as a guard for preventing intrusion of a wearing material such as sea water, sand mixed therein or the like into the inner part of the rope. For this reason, a life for a long period can be held also in use in the sea.

According to the ninth invention, when the drawing step is performed after the coating step, the resin which has just been coated also intrudes into the inner part of the yarn. Therefore, the resin serves as a binder for bundling raw threads constituting the yarn and reduces wear caused by rubbing if any. Moreover, the resin serves as a guard for preventing the intrusion of a wearing material such as sea water, sand mixed therein or the like into the inner part of the rope. Therefore, the life for a long period can be held also in use in the sea.

According to the tenth invention, when the drawing step is performed after the coating step, the resin which has just been coated intrudes into the inner part of the yarn. Therefore, the resin serves as a binder for bundling raw threads constituting the yarn and reduces wear caused by rubbing if any. Moreover, the resin serves as a guard for preventing the intrusion of a wearing material such as sea water, sand mixed therein or the like into the inner part of the rope. Therefore, the life for a long period can be held also in use in the sea.

EMBODIMENTS FOR CARRYING OUT THE INVENTION

Embodiments according to the present invention will be described in division into "a rope" and "a manufacturing method".

((Rope))

A rope according to embodiments of the present invention will be described with reference to FIGS. 1 and 2.

First of all, a basic structure of the rope will be described with reference to FIG. 1.

In general, a yarn is obtained by twisting raw threads, a strand is obtained by twisting a plurality of yarns and a rope is obtained by steel-making through a plurality of strands. The numbers of the raw threads, yarns and strands are optional.

Figure 1:
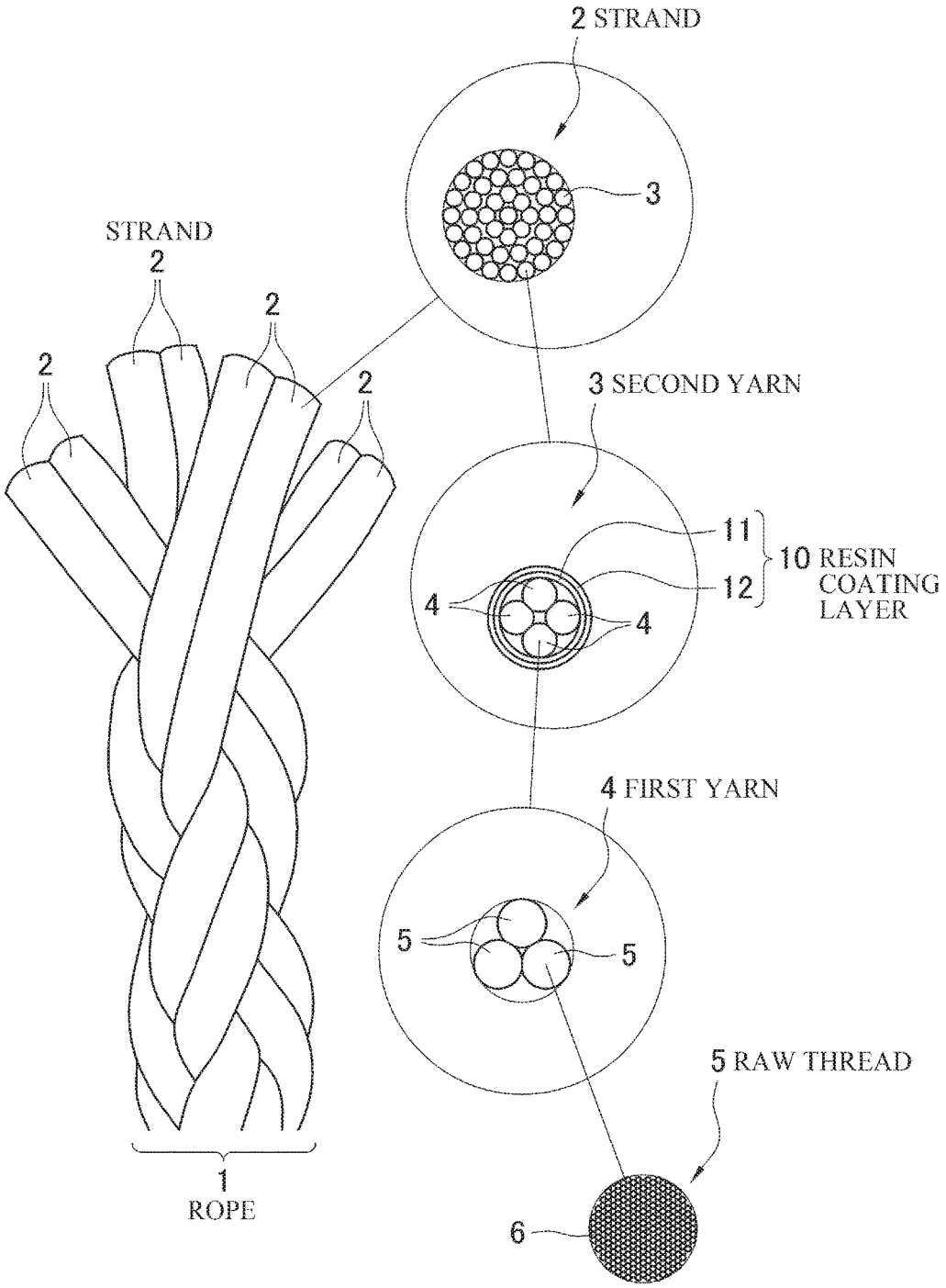
FIG. 1 is an explanatory view showing a structure of a rope according to an embodiment of the present invention.

FIG. 1 shows a typical example of the rope to which the present invention is applied, and the rope is configured as follows.

A raw thread 5 is obtained by arranging 1580 fibers 6 in a diameter of 12 μm. When three raw threads 5 are used and twisted, a first yarn 4 is obtained. When four first yarns 4 are used and twisted, a second yarn 3 is obtained. When 24 second yarns 3 are used and twisted, a strand 2 is obtained. A rope 1 is obtained by using eight strands 2 to perform steel-making.

In the present invention, a polyethylene fiber having an ultra high molecular weight is used for the raw thread 65.

The polyethylene fiber having the ultra high molecular weight is polyethylene in which an ordinary molecular weight of 2 to 300000 is increased up to 100 to 7000000 and has the following features.

The polyethylene fiber:

1) has a very high shock resistance.

2) is excellent in a wear resistance and has self-lubricity.

3) has a specific gravity of 0.92 to 0.97 and is lighter than water.

4) has no water absorbing property and is excellent in dimensional stability.

These properties are exactly inherited also in a state in which steel-making is performed for a rope.

The rope according to the present invention has the basic structure described above, and furthermore, has a resin coating layer 10 formed therein. The resin coating layer 10 serves to protect the rope. The resin coating layer 10 is formed to prevent intrusion of impurities such as sand into the inner part of the rope even if the rope is used in the sea, and to cause the rope to be worn with difficulty even if it comes in strong contact with a fixed thing in the sea and on the sea, thereby protecting the rope 1 to prolong a life.

The resin coating layer 10 is typically formed on an external surface of a yarn, particularly, an external surface of the second yarn 3. The resin coating layers 10 formed on an external surface of a strand and an external surface of a rope are included in the present invention. The reason is that the resin coating layer 10 can prevent intrusion of sand in the sea or the like and can also improve a wear resistance to external contact even if it is formed in any place of the external surface.

When the resin coating layer 10 is not formed on the external surface of the first yarn 4 but that of the second yarn 3, it is possible to produce a protecting effect with the same performance in a man hour which is one-xths (x is three to five) if the second yarn 3 is coated with a resin as compared with the case in which the first yarn 4 is coated with a resin.

A rope according to each of first to third embodiments applying three types of patterns in the resin coating layer 10 will be described with reference to FIGS. 2A, 2B, and 2C.

First Embodiment

Figure 2A:
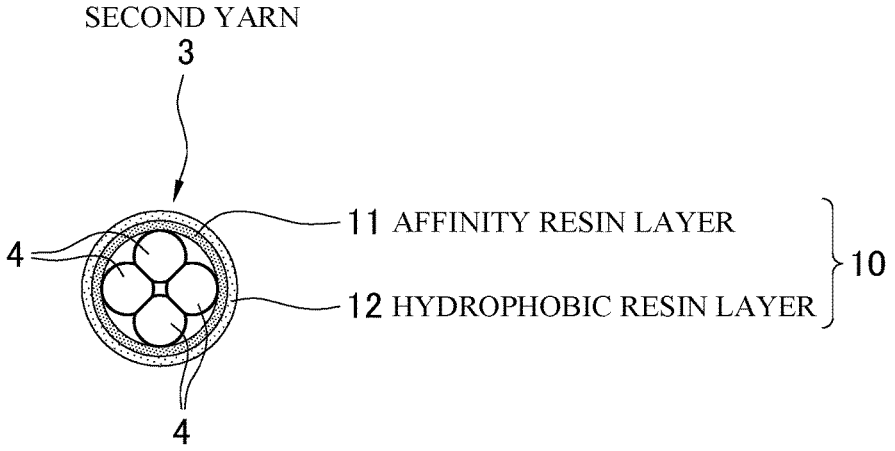
FIG. 2 is an explanatory view showing a resin coating layer of the rope according to the present invention.

As shown in FIG. 2A, the resin coating layer 10 provided on an outer periphery of the second yarn 3 is constituted by a resin layer 11 having affinity which is an inner coating layer and a hydrophobic resin layer 12 which is an outer coating layer formed on an external surface of the inner coating layer.

For the inner coating layer, there is used a resin having affinity to an external surface of a yarn which is surface-modified to be hydrophilic by a manufacturing method that will be described below. Herein, the resin having affinity is a water dispersible composition having oxygen-containing functional groups and can include hydrocarbon oligomer, ethylene-based copolymer, olefin-based block copolymer, polypropylene-based emulsion, urethane-based emulsion, acrylic emulsion, acrylonitrile-butadiene-styrene emulsion, modified latex emulsion, modified acrylic emulsion and the like, for example. Moreover, the resin may be a mixture constituted by at least two resins selected from them. In the case in which the inner coating layer is formed by using a resin having affinity to the yarn which is surface-modified to be hydrophilic, an excellent adhesion to the second yarn 3 is exhibited. Consequently, the protecting performance of the coating resin layer 10 for the rope 1 can be enhanced.

The outer coating layer is formed by a resin which is affinity and hydrophobic with respect to the affinity resin layer 11 of the inner coating layer. The hydrophobic resin can include fluorinated alkyl oligomer, organosilicon based polymer, coal tar, asphaltene and their mixtures and the like, for example, and is not restricted thereto. The hydrophobic resin layer 12 formed as described above repels sea water and prevents intrusion of impurities such as fine sand together with the sea water into the inner part of the rope 1

The second yarn 3 having the resin coating layer 10 formed therein is braided as the strand 2 in accordance with a usual method as shown in FIG. 1, and furthermore, is subjected to rope-making as the rope 1. The rope according to the first embodiment is thus obtained.

Referring to the rope 1, the affinity resin layer 11 of the inner coating layer causes the hydrophobic resin layer 12 of the outer coating layer to strongly adhere to the external surface of the second yarn 3. Therefore, breakage of a rope structure can be prevented from being caused by wear so that a life of the rope can be prolonged. Moreover, the hydrophobic resin layer 12 prevents the intrusion of sea water into the inner part of the rope 1. Consequently, the intrusion of impurities such as sand in the sea water can be prevented. Also in this respect, a wear resistance can be enhanced. Thus, the life of the rope can be prolonged.

Detailed description will be given in a manufacturing method which will be explained later. At a drawing step after a coating step, the affinity resin which has just been coated intrudes into an inner part of the second yarn 3. The resin intruding into the inner part serves as a binder for bundling raw threads constituted by a polyethylene fiber having an ultrahigh molecular weight forming the second yarn 3 to enhance the binding force of fibers. Even if the external coating layer breaks, moreover, the impurities such as fine stones are prevented from intruding into the inner part of the rope. Even if the fibers or yarns are rubbed against each other, furthermore, they act as friction reducing materials for reducing wear caused by the rubbing. From this viewpoint, furthermore, durability can be enhanced so that a life is prolonged.

Second Embodiment

Figure 2B:
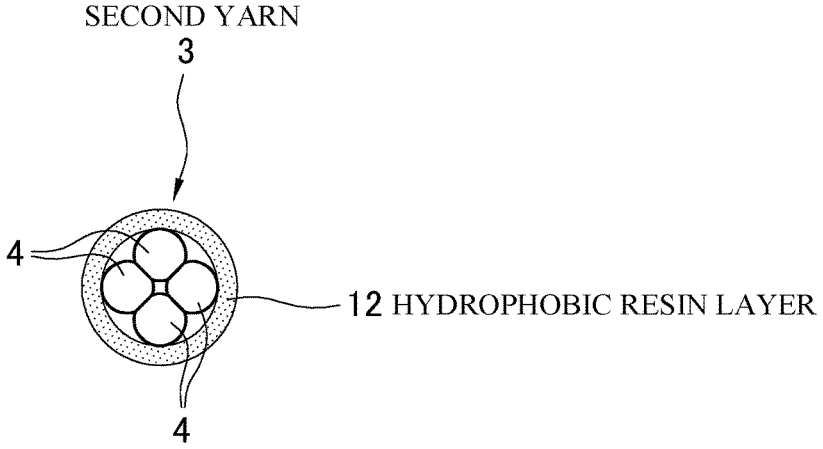

Referring to a rope according to a second embodiment, a resin coating layer 10 provided on an outer peripheral surface of a second yarn 3 includes only a hydrophobic resin layer 12 constituted by a hydrophobic resin as shown in FIG. 2B. The hydrophobic resin according to the first embodiment is particularly used without limit.

The second yarn 3 having the hydrophobic resin layer 12 formed thereon is braided as a strand 2 and is further subjected to rope-making as a rope 1 as shown in FIG. 1 in accordance with a usual method. This is a rope according to the second embodiment.

The rope 1 is coated with the hydrophobic resin layer 12 formed on the outer peripheral surface of the second yarn 3. Therefore, intrusion of the sea water into the rope is prevented. Consequently, intrusion of impurities such as sand in the sea water can be prevented. From this viewpoint, a wear resistance can be enhanced so that a life of the rope is also prolonged.

Detailed description will be given in a manufacturing method. At a drawing step after a coating step, an affinity resin which has just been coated intrudes into an inner part of the second yarn 3. The resin intruding into the inner part serves as a binder for bundling raw threads constituted by a polyethylene fiber having an ultrahigh molecular weight constituting the second yarn 3 to enhance the binding force of the fibers. Even if breakage or the like occurs in the outer coating layer, moreover, impurities such as small stones can be prevented from intruding into the inner part of the rope. Even if the fibers or yarns are rubbed against each other, furthermore, the resin serves as a friction reducing material for reducing wear caused by the rubbing. Also in this respect, therefore, durability can be enhanced and a life can be prolonged.

Third Embodiment

Figure 2C:
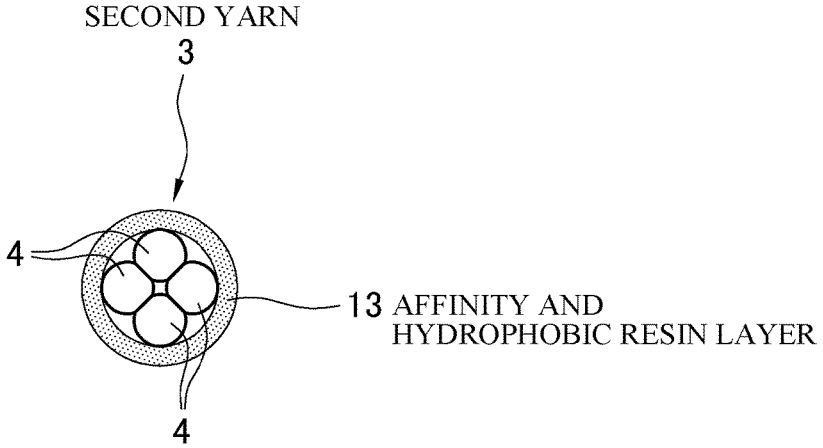

Referring to a rope according to a third embodiment, as shown in FIG. 2C, a resin coating layer provided on an outer peripheral surface of a second yarn 3 is constituted by an affinity and hydrophobic resin layer 13. The affinity and hydrophobic resin layer 13 is constituted by a resin having both properties of adhesion to a surface-modified raw thread and hydrophobicity. The affinity and hydrophobic resin layer 13 may be a kind of resin or a mixture of at least two types of resins. For the affinity and hydrophobic resin layer 13, the resin layer illustrated in the first embodiment or a mixture of at least two resins selected from the inner layer resins and the outer layer resins illustrated in the first embodiment is particularly used without limit.

Moreover, it is also possible to add a filler into these resins in order to enhance a wear resistance of the resin itself. For the filler, it is desirable to use a fibrous material or a polymer bulk body in consideration of a bending resistance. Examples include a recycled fiber, a vegetable fiber, carbon black, an SBS filler, an ABS filler, a PTFE filler and the like.

A second yarn 3 having the affinity and hydrophobic resin layer 13 formed thereon is braided as a strand 2 and is further subjected to rope-making as a rope 1 in accordance with a usual method as shown in FIG. 1. The rope according to the third embodiment is thus obtained.

Referring to the rope 1, an affinity resin contained in the affinity and hydrophobic resin layer 13 causes a hydrophobic resin of an outer layer to strongly adhere to the yarn 3. Therefore, a period for exhibiting a wear resistance can be prolonged. In addition, the hydrophobic resin prevents intrusion of sea water into the rope. Consequently, intrusion of impurities such as sand in the sea water can be prevented. From this viewpoint, similarly, the life of the rope can be enhanced.

Detailed description will be given in the following manufacturing method. At a drawing step after a coating step, the affinity resin which has just performed coating intrudes into an inner part of the second yarn 3. The resin intruding into the inner part serves as a binder for bundling raw threads constituted by a polyethylene fiber having an ultrahigh molecular weight constituting the second yarn 3 to enhance the binding force of the fibers. Even if breakage or the like occurs in the outer coating layer, moreover, impurities such as small tones can be prevented from intruding into the inner part of the rope. Even if the fibers or yarns are rubbed against each other, furthermore, the resin serves as a friction reducing material for reducing wear caused by the rubbing. Also in this respect, therefore, durability can be enhanced and a life can be prolonged.

((Manufacturing Method))

Next, a method of manufacturing a rope according to the present invention will be described.

The manufacturing method according to the present invention indicates a method of manufacturing a rope 1 which includes yarns 3 and 4 twisted by using a raw thread 5 of a polyethylene fiber having an ultrahigh molecular weight, and a strand 2 obtained by twisting he yarns 3 and 4, and is subjected to rope-making by the strand 2.

Figure 3:
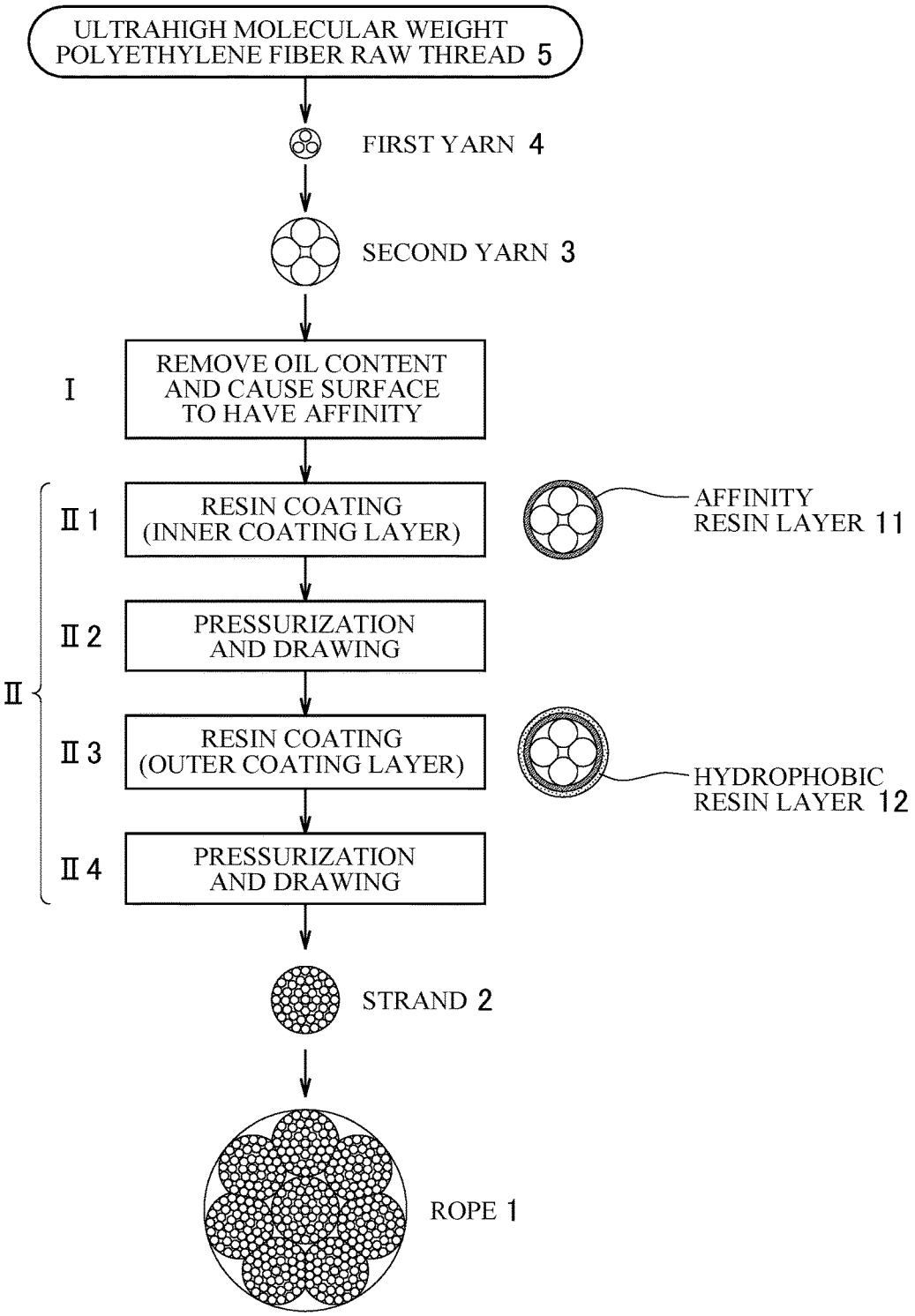
FIG. 3 is a view showing a process according to a first embodiment related to a method of manufacturing a rope according to the present invention.

As shown in FIG. 3, the manufacturing method features to perform a pretreating step I of removing an oil content contained in the rope 1 to cause a surface to have affinity to a resin to be coated, and subsequently, a resin coating step II of forming, on outer surfaces of the yarns 3 and 4, an outer surface of the strand 2 or an outer surface of the rope 1, a resin coating layer 10 for protecting the rope. Description will be given to three manufacturing methods corresponding to the ropes 1 according to the first to third embodiments (FIGS. 2A, 2B, and 2C).

(First Manufacturing Method)

FIG. 3 shows a method of manufacturing the rope (FIG. 2A) according to the first embodiment.

First of all, the first yarn 4 constituted by the raw thread 5 of a polyethylene fiber having an ultrahigh molecular weight is twisted to make the second yarn 3 by a usual method. In this stage, a pretreating step I and a resin coating step II which will be described below in detail are executed.

When the second yarn 3 is thus coated with a resin, it is possible to obtain a rope having the same performance in a processing man-hour of one-xths (x is three to five) as compared with the case in which the first yarn 4 is coated with a resin.

Pretreating Step I

Two methods including a) a UV treatment method and b) an atmospheric plasma method can be applied to the pretreating step I.

Referring to the UV treatment method, hydrogen peroxide is exposed to ultraviolet rays to generate an active radical. Referring to the atmospheric plasma method, a high voltage of approximately 10000 bolts is applied by using a high frequency power supply in the air to generate ozone or the like. When the second yarn 3 is exposed to such an environment, the pretreating step can be performed.

(Removal of Oil Content)

When the second yarn 3 is put in the environment, the oil content of the second yarn 3 is subjected to oxidation and decomposition. Consequently, the oil contents contained in the yarns 3 and 4 can be removed.

(Surface Affinity Enhancement)

Figure 4A:
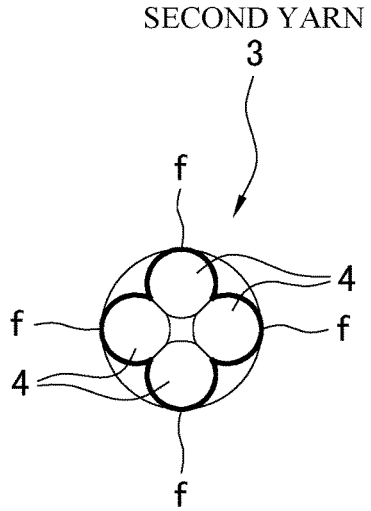
FIGS. 4A and 4B are explanatory views showing a pretreating step.

When the pretreating step for the second yarn 3 is advanced exactly after the removal of the oil contents, there is performed a treatment for causing the exposed surface of the second yarn 3 to have affinity. Herein, "an exposed surface f" represents an outward surface of the first yarn 4 configuring a surface of the second yarn 3 shown in FIG. 4A and indicates a portion exposed to a pretreatment atmosphere. In FIG. 4A, a portion shown in a thick line corresponds thereto.

Figure 4B:
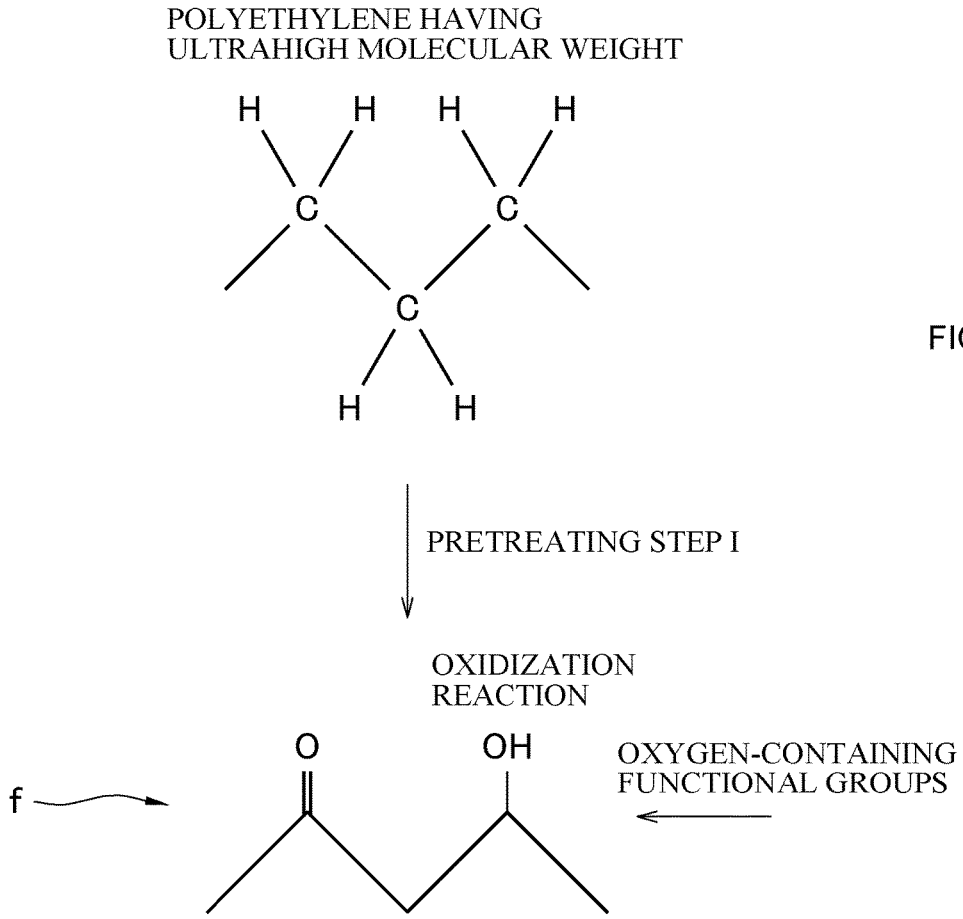

As a matter of course, as shown in FIG. 4B, the first yarn 4 is constituted by the polyethylene fiber having an ultrahigh molecular weight. Therefore, a chemical formula thereof has a structure in which H is bonded to C. By exposure to ozone, oxidation reaction occurs over the exposed surface of the polyethylene fiber having an ultrahigh molecular weight so that O and OH are introduced. O and OH are oxygen-containing functional groups. When the oxygen-containing functional groups are introduced, a hydrophilic resin easily adheres chemically. This treatment is referred to as a surface affinity enhancing treatment.

By executing the pretreating step I, conditions for removing the oil content to enable resin coating are met, and subsequently, affinity enhancement is performed over the exposed surface of the second yarn with respect to a resin to be coated. For example, a contact angle in the second yarn 3 before the execution of the pretreatment is approximately 900 and affinity enhancement is performed in such a manner that the contact angle after the pretreatment is equal to or smaller than 400. When the surface affinity enhancement is thus advanced, it is possible to obtain an effect for strong adhesion of the resin of the resin coating layer 11.

Resin Coating Step II

The resin coating step II includes a first coating step II1 of forming an affinity resin layer on the exposed surface of the second yarn 3 subjected to the pretreating step I, a first drawing step II2 of pressurizing and drawing the second yarn 3 subjected to the first coating step from an outer periphery, a second coating step II3 of forming a hydrophobic resin layer on an outer surface of the affinity resin layer of the second yarn 3 subjected to the first drawing step II2, and a second drawing step II4 of pressurizing and drawing the second yarn 3 subjected to the second coating step II3 from an outer periphery.

The first coating step II1 is executed by an optional method such as a method of spraying or dropping and applying an affinity resin in addition to a method of performing dipping the affinity resin into a water-dispersed tank. A dipping method may take a continuous construction method of bringing the second yarn 3 out while sequentially putting it into the tank or a batch mode for dipping the second yarn 3 in a certain amount into the tank and then bringing it up therefrom. Consequently, the affinity resin layer 11 is formed as an inner coating layer on the outer periphery of the second yarn 3. The continuous method is more suitable for long rope processing and a productivity can also be enhanced more greatly.

The first drawing step II2 is executed after the first coating II. The drawing process to be performed indicates pressurization from an outside of the second yarn 3 toward a center by a method of inserting the second yarn 3 through a dice or the like. By the pressurization, an affinity resin in a sufficient amount is infiltrated into the second yarn 3 while the excessive resin is scraped off.

When the first drawing step II2 is performed, the affinity resin which has just performed coating intrudes into an inner part of the second yarn 3. Therefore, the resin intruding into the inner part serves as a binder for bundling raw threads constituted by a polyethylene fiber having an ultrahigh molecular weight constituting the second yarn 3 to increase the binding force of the fibers. Even if breakage or the like occurs over an outer coating layer, impurities such as small stones can be prevented from intruding into the inner part of the rope. Even if the fibers or yarns are rubbed against each other, furthermore, they serve as friction reducing materials for reducing wear caused by the rubbing. Also in this respect, durability is enhanced so that a life of the rope can be prolonged.

Subsequently, the second coating step II3 is executed.

The second coating step II3 may be executed by a method of performing dipping the hydrophobic resin into a water-dispersed tank or the like. The dipping method may take a continuous method of sequentially bringing the second yarn 3 out while putting it into the tank or a batch mode for dipping the second yarn 3 in a certain amount into the tank and then bringing it up. Consequently, the hydrophobic resin layer 12 is formed as an outer coating layer on the external surface of the inner coating layer (the affinity resin layer 11).

The second drawing step II4 is executed after the second coating II3. The drawing treatment to be performed indicates pressurization from the outside of the second yarn 3 toward the center by the method of inserting the second yarn 3 through a dice or the like. By the pressurization, the hydrophobic resin is further infiltrated into the second yarn 3 while the excessive resin is scraped off.

When the second drawing step II4 is performed after the second coating step II3, the hydrophobic resin which has just performed coating intrudes into an inner part of the yarn in addition to the affinity resin which has already intruded into the inner part earlier. Therefore, a repellency of the surfaces of the yarns 3 and 4 can be enhanced. For example, a contact angle reaches 110° or more. For this reason, the hydrophobic resin layer 12 serves as a guard for preventing intrusion of sea water or impurities such as sand mixed therein into the inner part of the rope. Also in use in the sea, a life for a long period can be held.

The second yarn 3 subjected to the coating as described above is braided into the strand 2 in accordance with a usual method, and furthermore, is subjected to rope-making into the rope 1.

Consequently, there is obtained the rope 1 (see FIG. 1) in which pattern coating shown in FIG. 2A is formed.

Figure 5:
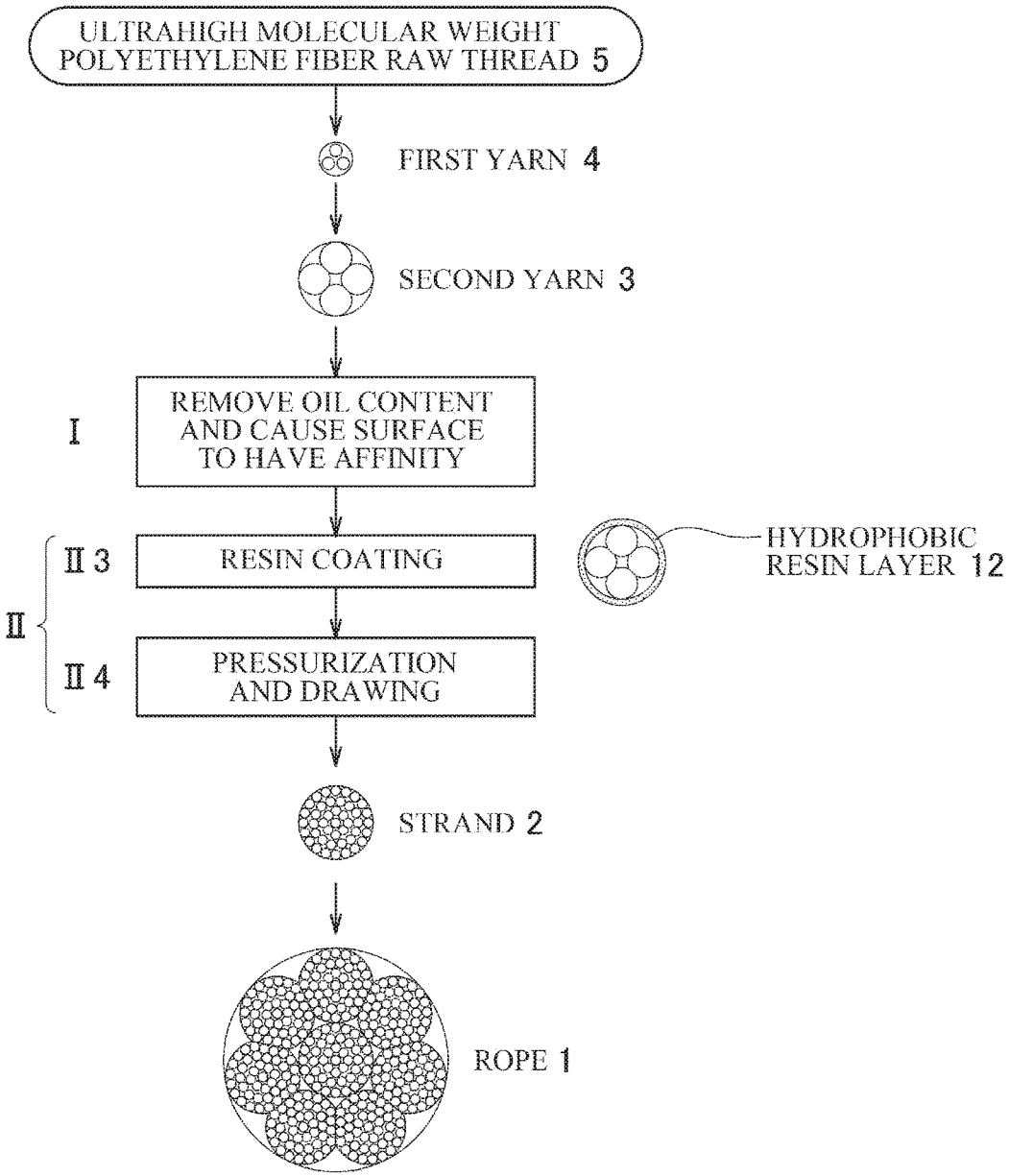
FIG. 5 is a view showing a process according to a second embodiment related to the method of manufacturing a rope according to the present invention.

FIG. 5 shows a method of manufacturing the rope (FIG. 2B) according to the second embodiment.

The pretreating step I according to the present embodiment includes removal of an oil content and a treatment for giving affinity to a hydrophobic resin which is to be performed next. Referring to the affinity enhancing treatment, it is possible to apply a UV treating method or an atmospheric plasma method which is employed in the first embodiment.

The pretreating step I for giving affinity to a hydrophobic resin is almost the same as that described in the first manufacturing method and a treatment using only a different drug is suitable. By performing a fluorine-containing chemical treatment reacting to ultraviolet rays or a plasma treatment over a fluorine-containing chemical, C on the surface of the polyethylene fiber having an ultrahigh molecular weight causes a reaction so that H is substituted for fluorine-containing functional groups.

Subsequently, the treatment proceeds to the resin coating step II. The resin coating step II includes a coating step II3 of forming the hydrophobic resin layer 12 on the surface of the second yarn 3 subjected to the pretreating step I and a drawing step II4 of performing pressurization and drawing over a yarn subjected to the coating step II3 from an outer periphery.

In other words, referring to the manufacturing method, the first coating step II1 and the first drawing step II2 shown in FIG. 3 are omitted, and the second coating step II3 and the second drawing step II4 are used. The residual steps are the same as those in the first embodiment.

There is used the hydrophobic resin forming the hydrophobic resin layer 12 which has been described above.

When the resin coating is performed in the coating step II3 and the drawing step II4 is then performed, the hydrophobic resin which has just been subjected to the coating also intrudes into an inner part of a yarn. Therefore, the repellency on the surfaces of the yarns 3 and 4 can be enhanced. For example, a contact angle reaches 1100 or more. For this reason, the hydrophobic resin layer 12 serves as a guard for preventing intrusion of impurities such as sea water or sand mixed therein into an inner part of a rope. Consequently, a life for a long period can be held also for use in the sea.

The second yarn 3 subjected to the coating as described above is braided into a strand 2, and furthermore, is subjected to rope-making into the rope 1 in accordance with a usual method. Consequently, there is obtained the rope 1 (see FIG. 1) on which the pattern coating shown in FIG. 2B is formed.

Figure 6:
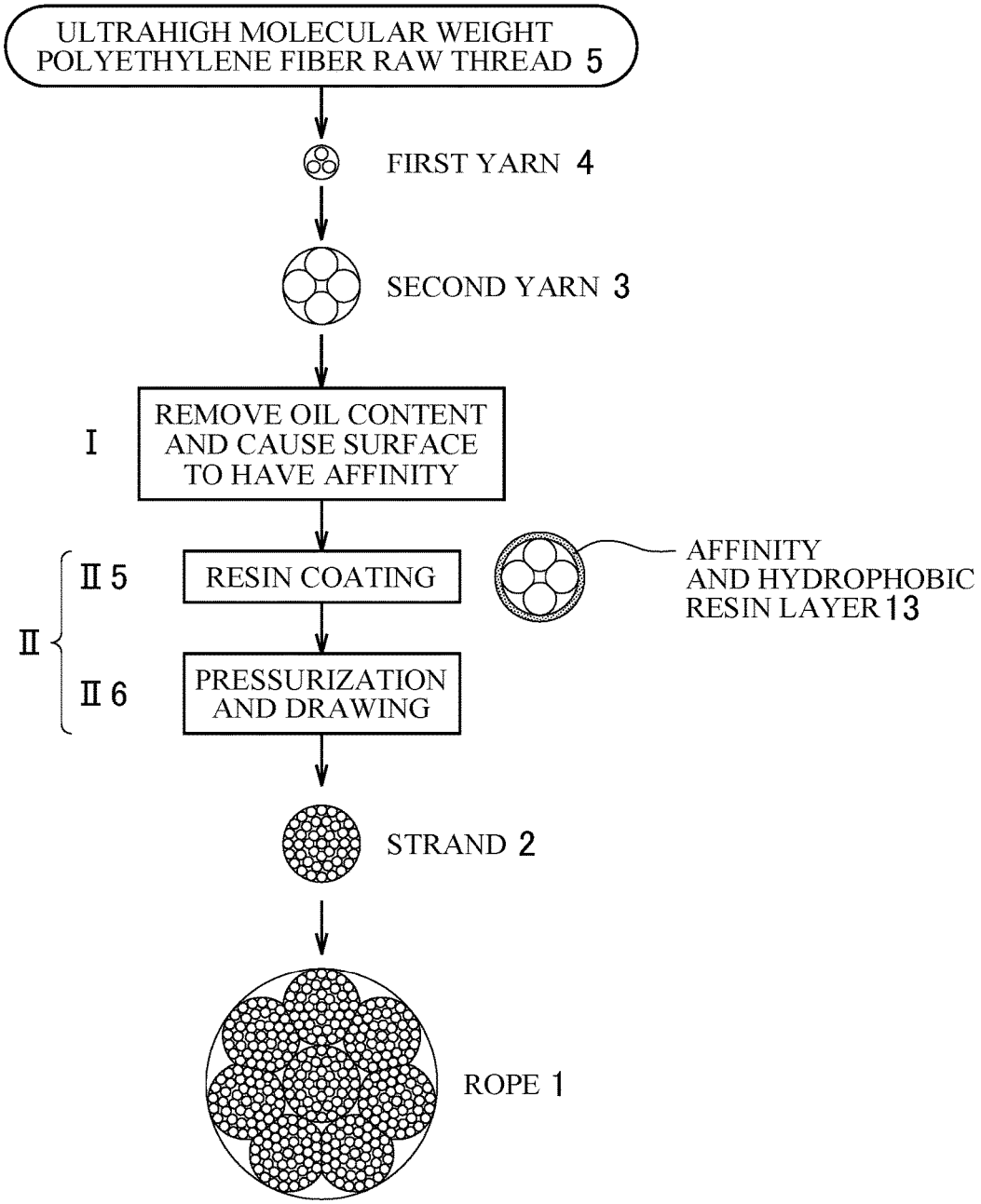
FIG. 6 is a view showing a process according to a third embodiment related to the method of manufacturing a rope according to the present invention.

FIG. 6 shows a method of manufacturing a rope (FIG. 2C) according to the third embodiment.

The pretreating step I according to the present embodiment includes the same oil content removal as that in the first embodiment and a surface affinity enhancing treatment to be performed subsequently.

The pretreating step I for giving affinity to a hydrophobic resin is almost the same as that described in the first manufacturing method.

Subsequently, the treatment proceeds to the resin coating step II. The resin coating step II includes a coating step II5 of forming an affinity and hydrophobic resin layer 13 on a surface of the second yarn 3 subjected to the pretreating step I, and a drawing step II6 of pressurizing and drawing the yarn subjected to the coating step II5 from an outer periphery.

The other manufacturing methods are the same as the method according to the first embodiment. This manufacturing method uses a resin having both properties of an affinity resin and a hydrophobic resin in place of use of the hydrophobic resin in the manufacturing method shown in FIG. 5.

When the drawing step II6 is performed after the coating of the resin at the coating step II5, the affinity resin and the hydrophobic resin which have just performed the coating intrude into the inner part of the yarn. Therefore, these resins serve as binders for bundling raw threads formed by a polyethylene fiber having an ultrahigh molecular weight constituting a yarn so that the binding force of the fibers can be enhanced. Consequently, a bending resistance can be enhanced. Even if the fibers or yarns are rubbed against each other, moreover, they serve as friction reducing materials for reducing a wear caused thereby. From this viewpoint, similarly, the bending resistance can be enhanced. Furthermore, the repellencies of the surfaces of the yarns 3 and 4 can be enhanced. For example, a contact angle reaches 110° or more. For this reason, the hydrophobic resin layer 12 serves as a guard for preventing intrusion of a wearing material such as sea water or sand mixed therein into the inner part of the rope. Thus, a life for a long period can be held also for use in the sea.

The second yarn 3 subjected to the coating as described above is braided into the strand 2, and furthermore, is subjected to rope-making into the rope 1 in accordance with a usual method. Consequently, there is obtained the rope 1 (see FIG. 1) having pattern coating formed thereon as shown in FIG. 2C.

Although all of the respective manufacturing methods perform the resin coating over the second yarn 3, the first yarn 4 may be instead coated, and furthermore, the resin coating may be performed in the state of the strand 2 and the resin coating may be performed in the state of the rope 1.

The rope 1 obtained by the manufacturing method has the following effects because it inherits properties of the polyethylene having an ultrahigh molecular weight, that is, 1) a high shock resistance, 2) an excellent wear resistance, 3) a smaller specific gravity than that of water and 4) no water absorbing property and an excellent dimensional stability.

1) The rope 1 has a very high shock resistance and is broken with difficulty even if a sudden tensile force or heavy load is applied.

2) The rope 1 is excellent in a wear resistance. Therefore, the rope 1 is damaged with difficulty even if it comes in contact with a fixed thing in or on the sea.

3) Since the rope 1 has a specific gravity of 0.92 to 0.97 and is lighter than the water, an exchanging work in the water can easily be performed.

In addition to the foregoing, the resin coating layer 10 is provided. Therefore, the rope can be protected. Specifically, waste, sand or the like in the sear does not intrude into the inner part of the rope. For this reason, a wear is not caused by rubbing of the yarns or strands, and furthermore, direct contact of the robe body is avoided by the resin coating layer even if the rope comes in contact with a fixed thing in the sea or on the sea. Consequently, it is possible to produce an advantage of an enhancement in the wear resistance of the rope.

Furthermore, a resin introducing into the inner part of the yarn serves as a binder or a friction reducing material. Therefore, a bending resistance can also be enhanced.

Referring to the rope 1 according to the present embodiment, moreover, it is possible to freely set a friction coefficient of the rope 1 based on a friction coefficient of a resin by a composite structure of a fiber and a resin. For this reason, a polyethylene fiber having an ultrahigh molecular weight originally has such a property as to tend to slip very easily. By applying a proper friction coefficient, it is possible to readily utilize the polyethylene fiber having an ultrahigh molecular weight as the rope 1.

Other Embodiments (1) Referring to the rope 1 according to each of the embodiments, the resin coating layer 10 is formed on the outer peripheral surface of the second yarn 3. However, the resin coating layer 10 may be formed on the outer peripheral surface of the first yarn 4. In this case, the manufacturing method can be applied to resin coating over the first yarn 4 at both of the pretreating step and the coating step.

(2) The resin coating layer 10 may be formed on the outer peripheral surface of the strand 2 or that of the rope 1 in addition to the outer peripheral surfaces of the yarns 3 and 4. Referring to a manufacturing method in this case, a coating step may be applied to the outer peripheral surface of the strand or that of the rope 1 in addition to application of only a pretreating step to the yarns 3 and 4 and both the pretreating step and the coating step may be performed in a state of the strand or the rope.

EXAMPLE

First Example

As a first example, the rope 1 in FIGS. 1 and 2A was prepared. Referring to the rope 1, 1580 polyethylene fibers 6 having ultrahigh molecular weights with a diameter of 12 μm were arranged to make the raw thread 5, three raw threads 5 were used and twisted to make the first yarn 4, four first yarns 4 were used and twisted to make the second yarn 3, four second yarns 3 were used and twisted to make the strand 2 and rope-making is performed by using eight strands 2.

Moreover, the rope 1 was manufactured by a first manufacturing method shown in FIG. 3. As a pretreating step I, an atmospheric plasma method was used. Hydrocarbon oligomer was used for an affinity resin and fluorinated alkyl oligomer was used for a hydrophobic resin. Even if a UV treating method was used as the pretreating step I, it is possible to obtain the same result by the following tests.

By using the first example, there were performed (1) a bending resistance fatigability test, (2) a wear resistance evaluation test, (3) an adhesive strength test and (4) a durability test. Results are shown as follows.

(1) Bending Resistance Fatigability Test

There was used an S shape bend testing machine capable of winding a rope to be a testing material around three rollers (a diameter of 75 mm) so as to take an S shape, coupling a weight (100 kg) to one of rope ends and coupling the other rope end to a motor-operated disk.

Testing conditions are as follows.

(Testing Condition)

An applied load of 100 kgf, a load factor of 25%, a speed of 4 reciprocations/minute, a stroke length of 510 mm, D/d of approximately 35-fold, a rotating direction of left, a disk rotating speed of 4 rotations/minute, a stroke length of 510 mm.

Herein, D represents an inner diameter of a sheave of 70 mm and d represents an outer shape of a second yarn of 2 mm.

As comparative examples, an oil content remains and the resin coating layer 10 is not provided in Comparative Example 1, and the oil content is removed and the resin coating layer 10 is not provided in Comparative Example 2.

Referring to a testing method, an integrated number of rotations of the disk was calculated until the second yarn 3 to be the testing material breaks. As a result, the Comparative Example 1 indicates 3001 times and the Comparative Example 2 indicates 2307 times, while the Example 1 indicates 7226 times which represents a double to three-fold bending resistance fatigability. Consequently, it is apparent that the rope 1 according to the Example 1 has a very excellent bending resistance.

(2) Wear Resistance Evaluation Test

Referring to a wear resistance test, there was performed a wear test adding an abrasive into artificial seawater to measure a residual strength.

Conditions of the wear resistance test are as follows.

The PE11 container supplied by Sanplatec Corporation was used for a container. 300 cc of Sea water supplied by Gex Corporation was used for the artificial sea water. 40 g of SuperSol which is a porous and light foaming material (an artificial pumice obtained by grinding, burning and foaming a waste glass) supplied by Kokko Co., Ltd. was used for the abrasive. A close dimension to a particle size having a length of 20 mm, a width of 15 mm and a height of 10 mm was selected for a particle size of the abrasive.

A second yarn was put in a PE container having artificial sea water and an abrasive therein, which was put in a rotary raw material agitating machine to continuously perform the wear test for five hours, thereby obtaining a breaking strength through an Amsler's tensile testing machine to calculate a residual strength ratio. Results are as follows.

A residual strength ratio of 28.5% was obtained in the Comparative Example 1, while a residual strength ratio of 73.1% was obtained in the Example 1. When the test was performed with a variation in a type of the resin in the Example 1, moreover, it was apparent that a residual strength ratio ranges from approximately 55% to 73% and a double to threefold performance is obtained as compared with the Comparative Examples. Consequently, it is apparent that the rope according to the Example 1 has a very excellent wear resistance.

INDUSTRIAL APPLICABILITY

Next, description will be given to an example of use of the rope according to the present invention.

Figure 7:
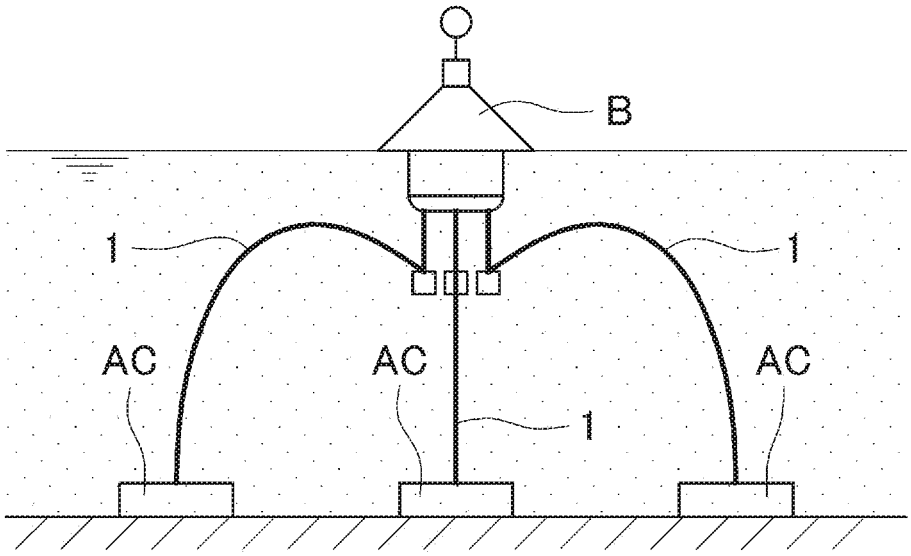
FIG. 7 is an explanatory view showing an example of use of the rope according to the present invention.
Figure 8:
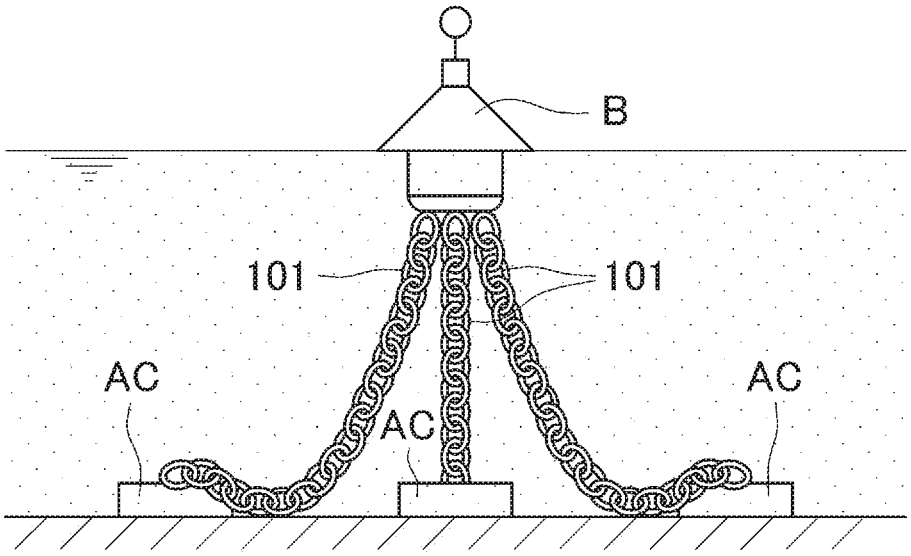
FIG. 8 is an explanatory view showing a mooring chain used conventionally.

As a typical example of use, it is possible to illustrate a rope for mooring an offshore structure or a ship. For instance, in an example shown in FIG. 7, a ship mooring buoy B floating on a sea surface and an anchor AC provided on a sea bottom are coupled to each other through the rope 1 according to the present invention. Since the rope 1 has a specific gravity of one or less, it is curved to float without hanging. For the specific gravity of the rope for mooring is smaller than that of the sea water. Therefore, the rope does not come in contact with the sea bottom, and furthermore, a resin coating layer for protecting the rope is formed. Thus, waste, sand or the like in the sea can be prevented from intruding into the inner part of the rope. For this reason, wear is not caused by rubbing of yarns or strands, and furthermore, the direct contact of a rope body can be avoided by the resin coating layer even if the rope comes in contact with a fixed thing in the sea or on the sea. Consequently, the wear resistance of the rope can be enhanced. Since a weight is light, moreover, an exchanging work is easy to perform. Since sea water is not contained in the inner part, furthermore, a life can be prolonged.

The rope according to the present invention can be utilized in all technical fields in addition to mooring in the sea or on the sea described above.

EXPLANATION OF DESIGNATIONS

1: rope
2: strand
3: second yarn
4: first yarn
5: raw thread
6: fiber
I: pretreating step
II: resin coating step
II: first coating step
II2: first drawing step
II3: second coating step
II4: second drawing step

The invention claimed is:

1. A rope including a yarn twisted by using a raw thread of a polyethylene fiber having an ultrahigh molecular weight and a strand twisted by the yarn and subjected to rope-making through the strand, wherein an oil content is removed from the yarn and an affinity enhancing treatment is performed over a surface of the yarn, a resin coating layer for protecting the rope is formed on an external surface of the yarn, an external surface of the strand or an external surface of the rope, the resin coating layer is configured to bind the raw thread in an inner part of the yarn, and the affinity enhancing treatment includes a UV treatment method or an atmospheric plasma method to cause an oxidation reaction over an exposed surface of the polyethylene fiber of the yarn and thereby to cause introduction of an oxygen containing functional group, O, OH, or a combination thereof, to CH that is included in a chemical formula of the polyethylene fiber of the yarn.

2. The rope according to claim 1, wherein the yarn is a second yarn obtained by twisting a first yarn.

3. The rope according to claim 1, wherein the resin coating layer includes an inner coating layer constituted by a resin layer having affinity to the raw thread and an outer coating layer constituted by a hydrophobic resin layer formed on an external surface of the inner coating layer.

4. The rope according to claim 1, wherein only a hydrophobic resin layer constituted by a hydrophobic resin is used for the resin coating layer.

5. The rope according to claim 1, wherein the resin coating layer is constituted by an affinity and hydrophobic resin layer having both properties of an affinity resin and a hydrophobic resin.

6. A method of manufacturing a rope including a yarn twisted by using a raw thread of a polyethylene fiber having an ultrahigh molecular weight and a strand twisted by the yarn and subjected to rope-making through the strand, the method comprising:

a pretreating step of removing an oil content contained in the rope and performing an affinity enhancing treatment over a surface thereof; and a resin coating step of forming a resin coating layer for protecting the rope over an external surface of the yarn, an external surface of the strand or an external surface of the rope and intruding the resin coating layer into an inner part of the yarn to form a binder that binds the raw thread, wherein the removing the oil content contained in the rope includes a UV treatment method, an atmospheric plasma method, or a combination thereof, the UV treatment method includes exposing the rope to hydrogen peroxide that is exposed to ultraviolet rays to generate an actual radical, and the atmospheric plasma method includes exposing the rope to ozone generated by applying a high voltage of approximately 10,000 bolts by a high frequency power supply in the air.

7. The method of manufacturing a rope according to claim 6, wherein the pretreating step is executed in a state of a yarn.

8. The method of manufacturing a rope according to claim 7, wherein the resin coating step includes:

a first coating step of forming an affinity resin layer having affinity to the raw thread on a surface of a yarn subjected to the pretreating step;

a first drawing step of pressurizing and drawing the yarn subjected to the first coating step from an outer periphery;

a second coating step of forming a hydrophobic resin layer on an external surface of the affinity resin layer of the yarn subjected to the first drawing step; and a second drawing step of pressurizing and drawing the yarn subjected to the second coating step from an outer periphery.

9. The method of manufacturing a rope according to claim 7, wherein the resin coating step includes:

a coating step of forming a hydrophobic resin layer on a surface of a yarn subjected to the pretreating step; and a drawing step of pressurizing and drawing the yarn subjected to the coating step from an outer periphery.

10. The method of manufacturing a rope according to claim 7, wherein the resin coating step includes:

a coating step of forming an affinity and hydrophobic resin layer on a surface of a yarn subjected to the pretreating step; and a drawing step of pressurizing and drawing the yarn subjected to the coating step from an outer periphery.

11. The rope according to claim 1, wherein the oil content contained in the yarn is removed by an UV treatment method, an atmospheric plasma method, or a combination thereof, the UV treatment method includes exposing the yarn to hydrogen peroxide that is exposed to ultraviolet rays to generate an actual radical, and the atmospheric plasma method includes exposing the yarn to ozone generated by applying a high voltage of approximately 10,000 bolts by a high frequency power supply in the air.

12. A method of manufacturing a rope including a yarn twisted by using a raw thread of a polyethylene fiber having an ultrahigh molecular weight and a strand twisted by the yarn and subjected to rope-making through the strand, the method comprising:

a pretreating step of removing an oil content contained in the rope and performing an affinity enhancing treatment over a surface thereof; and a resin coating step of forming a resin coating layer for protecting the rope over an external surface of the yarn, an external surface of the strand or an external surface of the rope and intruding the resin coating layer into an inner part of the yarn to form a binder that binds the raw thread, wherein the affinity enhancing treatment includes a UV treatment method or an atmospheric plasma method to cause an oxidation reaction over an exposed surface of the polyethylene fiber of the rope and thereby to cause introduction of an oxygen containing functional group, O, OH, or a combination thereof, to CH that is included in a chemical formula of the polyethylene fiber of the rope.

* * * * *